United States Patent [19]

Russeau

[11] Patent Number: 4,593,794

[45] Date of Patent: Jun. 10, 1986

[54] APPARATUS AND METHOD FOR INSTALLING ELEVATOR RAILS

[75] Inventor: Raymond J. Russeau, Sylvania, Ohio

[73] Assignee: Schindler Haughton Elevator Corporation, Toledo, Ohio

[21] Appl. No.: 602,829

[22] Filed: Apr. 23, 1984

[51] Int. Cl.[4] ..... B66B 7/02

[52] U.S. Cl. ..... 187/95; 187/1 R; 33/404

[58] Field of Search ..... 187/95, 1 R; 29/429, 29/433, 407, 464, 466, 468; 52/31, 30, 365, 364, 741; 33/333, 339, 392, 404, 406

[56] References Cited

U.S. PATENT DOCUMENTS

| | | | |
|---|---|---|---|
| 2,402,888 | 6/1946 | Hall | 33/404 |
| 3,851,736 | 12/1974 | Westlake et al. | 187/95 |
| 3,948,358 | 4/1976 | Atkey | 187/95 |
| 4,345,671 | 8/1982 | Tosato et al. | 187/95 |

*Primary Examiner*—Joseph J. Rolla
*Assistant Examiner*—Kenneth Noland
*Attorney, Agent, or Firm*—Willian Brinks Olds Hofer Gilson & Lione

[57] ABSTRACT

An apparatus and method for installing car and counterweight rails for elevators accurately positioned the rails in a linear, parallel orientation. The apparatus includes a pair of mirror-image guide assemblies which attach to the rails. Each assembly includes an adjustable reference guide assembly which positions the rail relative to an adjacent plumb line. The assembly also includes an interconnecting guide line which ensures co-planar disposition of certain rail surfaces. The method includes the steps of suspending the car and counterweight rails within the elevator shaft from above. A plumb line is suspended adjacent each rail. The lower terminus of each rails is then secured in an appropriate position relative to the other rails and the hoistway walls. The guide assemblies are then secured to the rails and adjusted to receive the plumb line in a reference location. The assemblies are then incrementally moved up the rails, the rails are adjusted such that the plumb line is received within the assemblies at the reference location and the rails are secured to the shaft walls in the desired position.

15 Claims, 7 Drawing Figures

APPARATUS AND METHOD FOR INSTALLING ELEVATOR RAILS

BACKGROUND OF THE INVENTION

The instant invention relates to elevator installation and more specifically to an apparatus and method for accurately positioning elevator guide rails in linear and parallel orientation.

Increasingly sophisticated control systems, improved drive and braking components and constantly rising performance requirements have all combined to steadily increase the operating speed of electric, cable suspended elevators. Such increased operating speeds are not without attendant difficulties. Perhaps the most significant difficulty, certainly from a passenger comfort standpoint, is rapid, random lateral motion of the car during its vertical traverse due to irregularities in the placement of the guide rails upon which the car moves. A pair of opposed rails are disposed on the sidewalls of the elevator shaft and rollers or similar structures engage parallel faces of the rail to maintain appropriate car position. Variations in rail linearity substantially less than one-half inch due to variations in the sidewalls to which they are received, for example, can cause discomfort to passengers, particularly at higher elevator car speeds.

Significant time and effort has therefore been devoted to schemes for positioning the rails in a linear, parallel disposition on the walls of the elevator shaft. For example, a plumb line may be hung generally adjacent brackets to which the guide rails will be secured and the rails trued to the plumb line. While it is apparent that this scheme provides reasonably accurately positioned rails, it cannot ensure mounting of the rails within the narrow tolerances which are presently viewed as desirable. Furthermore, and less apparent, is the failure of such a system to accurately and commonly position the planes of opposed rails i.e., ensure that each rail is true and parallel to the other rail of a pair in addition to being linearly oriented.

U.S. Pat. No. 3,851,736 teaches an apparatus and method wherein a rig is lowered into the hoistway by a hoist and the rail sections are assembled by raising a rail approximately its own length, securing the next lower rail to the bottom of the raised rail and repeating the operation until complete car and counterweight guide rail assemblies extend from the lowermost to the uppermost portion of the hoistway. U.S. Pat. No. 4,345,671 discloses another apparatus and method for installing elevator guide rails. Here, a cone or cap is placed upon the upper end of each of the guide rails and they are raised by pushing them up approximately their own length from their lower terminus, securing an additional rail section to the lower terminus and repeating the procedure until the top of the rail is at the top of the hoistway. Here, too, the support unit or platform is utilized to position the guide rails prior to their securement to the hoistway walls.

A review of these patents as well as other prior art activity relating to uniform linear and parallel guide rail placement in a hoistway reveals certain shortcomings and the desirability of new apparatus and methods.

SUMMARY OF THE INVENTION

The instant invention relates to an apparatus and method for installing elevator car and counterweight guide rails such that individual rails exhibit highly linear characteristics and that pairs of opposed rails are oriented in a parallel, co-planar manner. The apparatus includes a pair of mirror-image reference guide assemblies which are interconnected by an extensible line or cord. Each guide assembly includes a clamping device which quickly and securely attaches the guide assembly to a respective one of a pair of guide rails which are being mounted to the elevator hoistway wall. Each guide assembly further includes an adjustable reference mechanism which receives a plumb line and, once adjusted, may thus be utilized to position the entire length of the guide rail relative to the adjacent plumb line. Reference markings are also included on each guide assembly which cooperate with the interconnecting line to ensure parallelism of certain guide rail surfaces. The guide rail installation method includes the steps of suspending each guide rail from above in the hoistway. A plumb line is then suspended adjacent each of the four guide rails. The lower terminus of each rail is then secured to the wall of the hoistway in an appropriate location determined by measurement and proper positioning of the elevator car within the hoistway. The reference guide assemblies of the apparatus are then secured to respective ones of a pair of guide rails for the elevator car or counterweight and adjusted to receive the plumb line in an appropriately designated reference location. The guide assemblies are then moved up the rails a short distance and the rails are positioned laterally and angularly such that both the pair of plumb lines are disposed accurately at or within the indicated reference location and the interconnecting cord indicates that proper parallelism of the faces of the guide rails has been achieved. Finally, the rails are secured to the hoistway walls by the use of suitable adjustable brackets. The foregoing steps are then repeated at appropriate intervals until the upper termini of the pair of guide rails are appropriately positioned relative to the associated plumb lines. The entire process is then repeated for the second pair of guide rails.

It will therefore be appreciated that the foregoing method provides a rapid, accurate and straightforward method whereby elevator car and counterweight guide rails may be accurately positioned within a hoistway to minimize lateral runout and also that the guide reference assemblies are rugged, easy to use and facilitate such accurate installation.

Thus it is an object of the instant invention to provide an apparatus for accurately positioning the guide rails for elevators in a linear, parallel orientation.

It is a further object of the instant invention to provide an apparatus which is simple to use, is accurate in operation and is inexpensive to manufacture.

It is a still further object of the instant invention to provide a method for installing elevator guide rails in linear, parallel orientation.

It is a still further object of the instant invention to provide a method for installing elevator guide rails which exhibit substantially reduced lateral runout when compared to guide rails installed by prior art methods.

Further objects and advantages of the instant invention will become apparent by reference to the following description of the preferred embodiment and attached drawings.

DESCRIPTION OF THE PREFERRED EMBODIMENT

Figure 1:
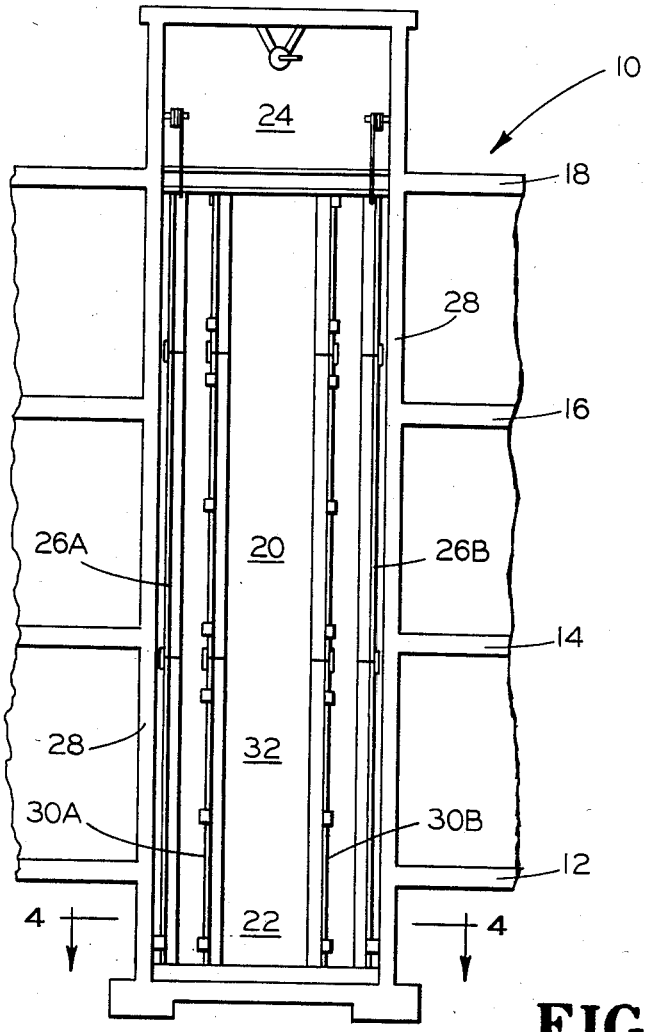
FIG. 1 is a diagrammatic view of an elevator hoistway in a three story building which is illustrative of hoistways and elevator installations in general.

Referring now to FIG. 1, a diagrammatic view of a building 10 having a ground or first floor 12, a second floor 14 and a third floor 16 is illustrated. Each of the floors, 12, 14 and 16 includes occupiable space located directly above and the building 10 further includes a roof 18. It will be appreciated that the building 10 illustrated is illustrative and exemplary only and that the instant apparatus and method is fully applicable to buildings 10 and similar structures having but two or substantially greater numbers of floors. Disposed normal to the parallel planes of the floors 12, 14 and 16 and the roof 18, is an elevator hoistway 20. The elevator hoistway 20 extends generally below the ground or first floor 12 and defines a pit 22 and similarly extends generally above the roof 18 to define an equipment room 24.

Figure 2:
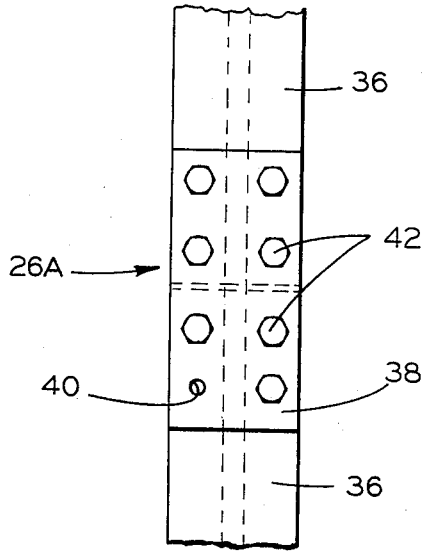
FIG. 2 is a fragmentary elevational view of interconnected ends of elevator guide rails.
Figure 3:
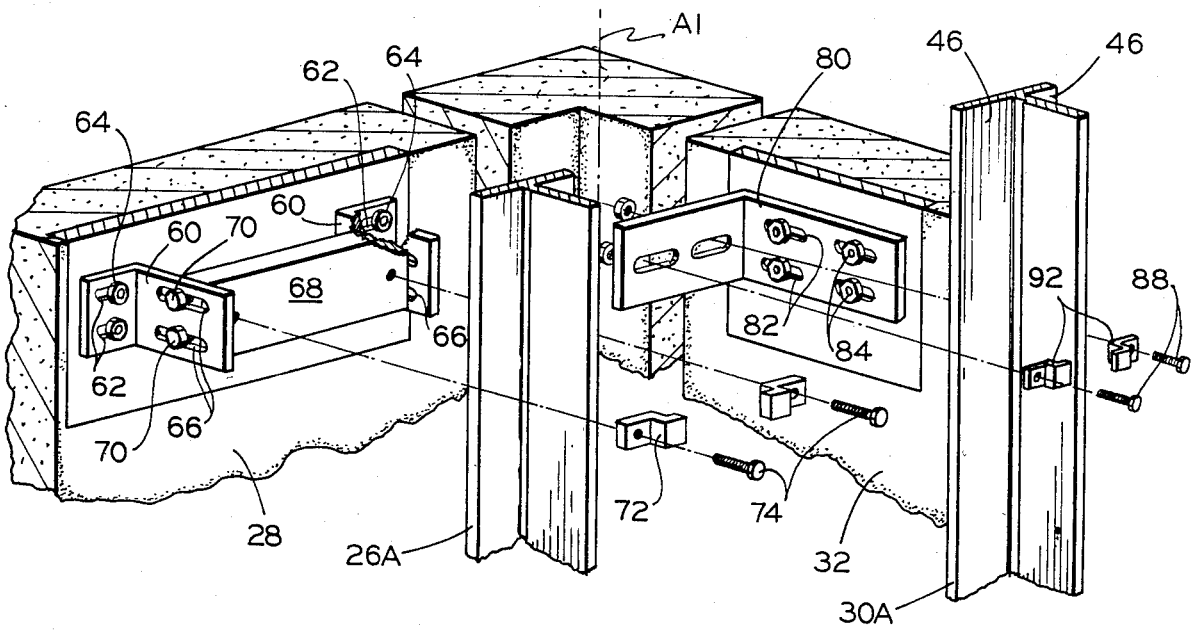
FIG. 3 is an exploded, perspective view of elevator guide rails and mounting structures in a hoistway.

Referring now to FIGS. 1, 2 and 3, it will be appreciated that a plurality of vertically oriented guide rails extend substantially the full length of the elevator hoistway 20. A first pair of parallel guide rails includes a left guide rail 26A and the left guide rail 26B which, but for their opposed orientation, are identical. The guide rails 26A and 26B cooperatively provide a pathway for an elevator car (not illustrated) which extends from the first floor 12 to the third floor 16. A second pair of guide rails, a left guide rail 30A and a right guard rail 30B are disposed on the rear wall 32 of the elevator hoistway 20. The guide rails 30A and 30B but for their opposed mirror-image orientation are identical. The left guide rail 30A and right guide rail 30B cooperatively provide a vertical pathway for the counterweight assembly (not illustrated) associated with the elevator car. Each of the guide rails 26A, 26B, 30A and 30B consist of a plurality of substantially identical guide rail sections 36 having a length of approximately 16 feet or other suitable length. Adjacent ends of guide rail sections 36 are secured together by fishplates 38 having a plurality of suitably sized openings 40 which match similarly positioned openings (not illustrated) adjacent the ends of the guide rail sections 36. Threaded fasteners 42 or similar devices may be utilized to secure the fish plates 32 and juxtaposed rail sections 36 together. The use of fishplates 38 is a conventional means for interconnecting guide rail sections 36 and will therefore not be described in greater detail.

Figure 4:
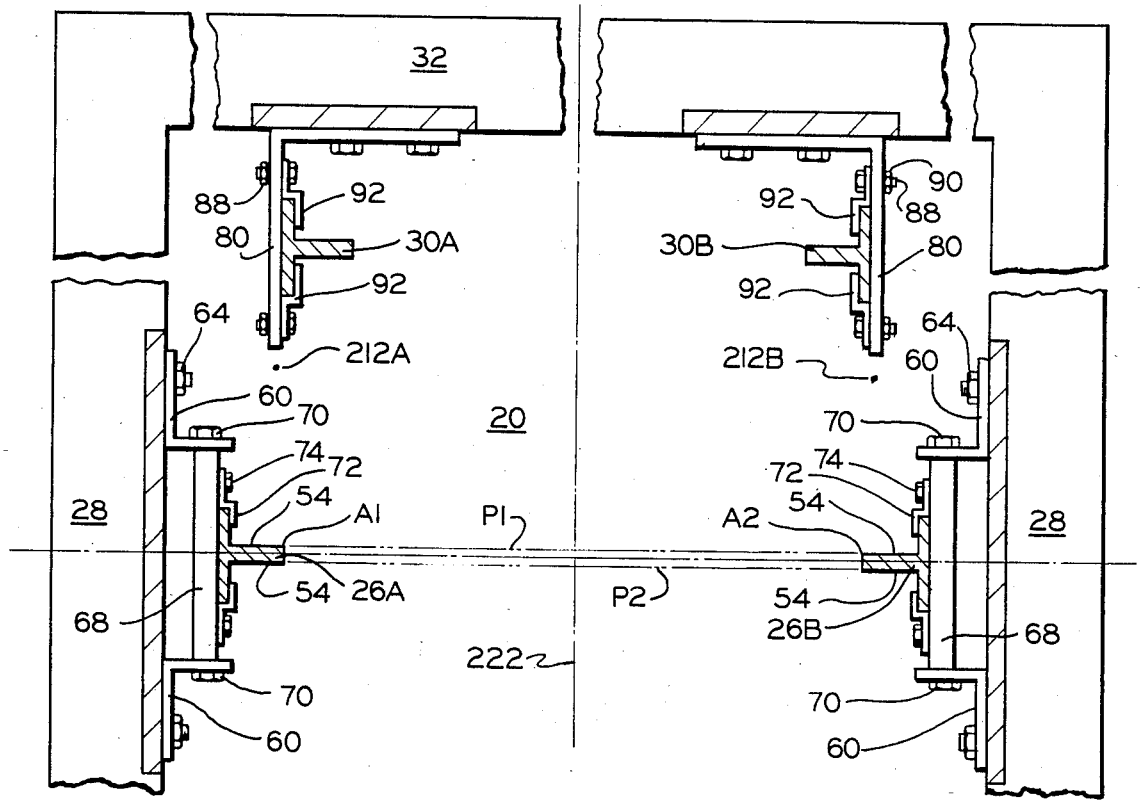
FIG. 4 is a full, sectional view taken along line 4—4 of FIG. 1 of elevator guide rails and mounting structures in a hoistway.
Figure 6:
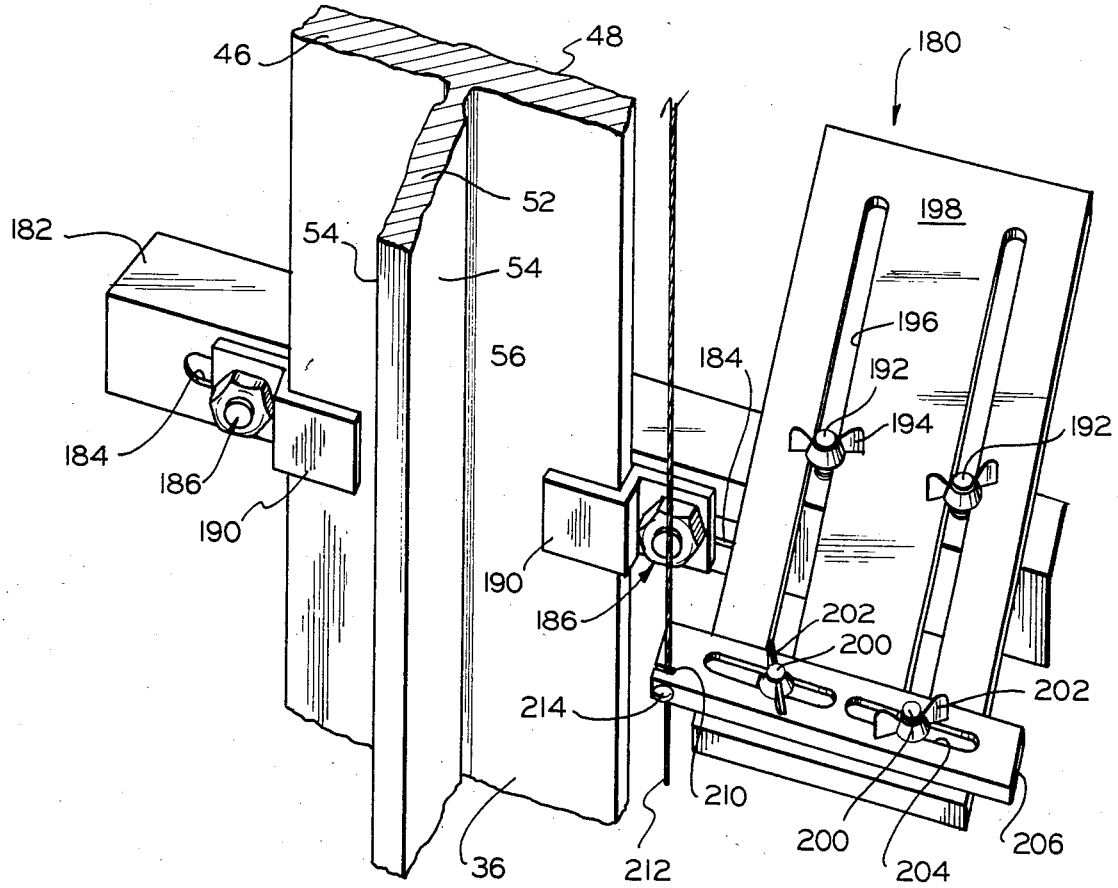
FIG. 6 is a perspective view of a plumb line stabilizing assembly according to the instant invention in place on an elevator guide rail.

As illustrated in FIGS. 3, 4, and 6, each of the guide rails 26A, 26B, 30A and 30B (only 26A and 30A being illustrated in FIG. 3) is T-shaped in cross section and includes a flange portion 46 having a planar rear surface 48. Disposed perpendicularly to the planar rear surface 48 and extending from the opposite face of the flange 46 is a rail portion 50 having opposed parallel guide rail surfaces 54 and a perpendicular intersecting end guide surface 56. As those familiar with elevator installations will readily appreciate, this rail section 36 is conventional. The guide surfaces 54 and 56 cooperate with rollers (not illustrated) and other rolling and positioning mechanisms to guide the elevator car and the counterweight as they translate vertically along the hoistway 20 according to conventional practice. Each of the guide rails 26A, 26B, 30A and 30B is secured to the adjacent respective wall 28 or 32 of the hoistway 20 by brackets which permit adjustment of the final, installed position of the guide rails 26A, 26B, 30A and 30B along perpendicular axes in a horizontal plane relative to the adjacent sidewall. Such adjustable brackets are disposed at suitable vertically spaced-apart intervals along the entire length of each of the guide rails 26A, 26B, 30A and 30B. With regard to the pair of opposed guide rails 26A and 26B associated with the elevator car, the adjustable brackets take the form of a pair of L-shaped or right angle brackets 60 disposed in mirror-image pairs. Each of the brackets 60 includes pairs of elongate slots 62 disposed in the leg of the bracket 60 adjacent the sidewall 28 which provide lateral adjustment of the position of the bracket 60. Suitable fasteners such as bolts 64 which may be tightened to fix the position of the brackets 60 according to conventional practice. The brackets 60 also each include an additional pair of elongate slots 66 which permit adjustment of a guide rail receiving plate 68. The plate 68 is adjustably secured to the L-shaped brackets 60 by suitable threaded fasteners 70 received within the elongate slot 66. The guide rail 26A as well as the guide rail 26B are then secured to the plate 68 by a pair of clips 72 which each engage a respective one of the flanges 46 of the guide rail 26A and appropriate threaded fasteners 74. Thus it will be appreciated that the foregoing mounting structure, particularly the elongate slots 62 and 66 formed in the L-shaped bracket 60 permit adjustment of the ultimate position of the guide rails 26A and 26B both laterally (parallel) and perpendicularly relative to the sidewall 28.

A somewhat similar scheme is utilized to adjustably secure the guide rails 30A and 30B associated with the counterweight to the rear wall 32 of the elevator hoistway 20. The adjustable securement scheme includes a plurality of pairs of spaced apart mirror-image brackets 80. One arm of the bracket includes elongate slots 82 which receive suitably sized threaded fasteners 84 which are secured to the rear wall 32 of the elevator hoistway. Cooperation between the elongate slots 82 and threaded fasteners 84 permits lateral adjustment of the bracket 80 and tightening of the fasteners 84 secures the bracket 80 to the rear wall 32. The arm of the bracket 80 extending away from the rear wall 32 includes a pair of elongate slots 86 which receive threaded fasteners 88 and suitable nuts 90 associated with a respective one of a pair of clips 92 which engage the flange 46 of each section 36 of the guide rails 30A and 30B. Cooperation between the threaded fasteners 88 and elongate slots 86 permit adjustment of the position of the guide rails 30A and 30B toward and away from the rear wall 32 of the elevator hoistway 20 and tightening the fasteners 88 secures the guide rails 30A and 30B to the brackets 80. It will be appreciated that the L-shaped bracket 60 and right angle brackets 80 will be disposed in spaced-apart vertical intervals along the entire length of each of the guide rails 26A, 26B, 30A and 30B as required to provide suitable mechanical support and rigidity thereto.

Figure 5:
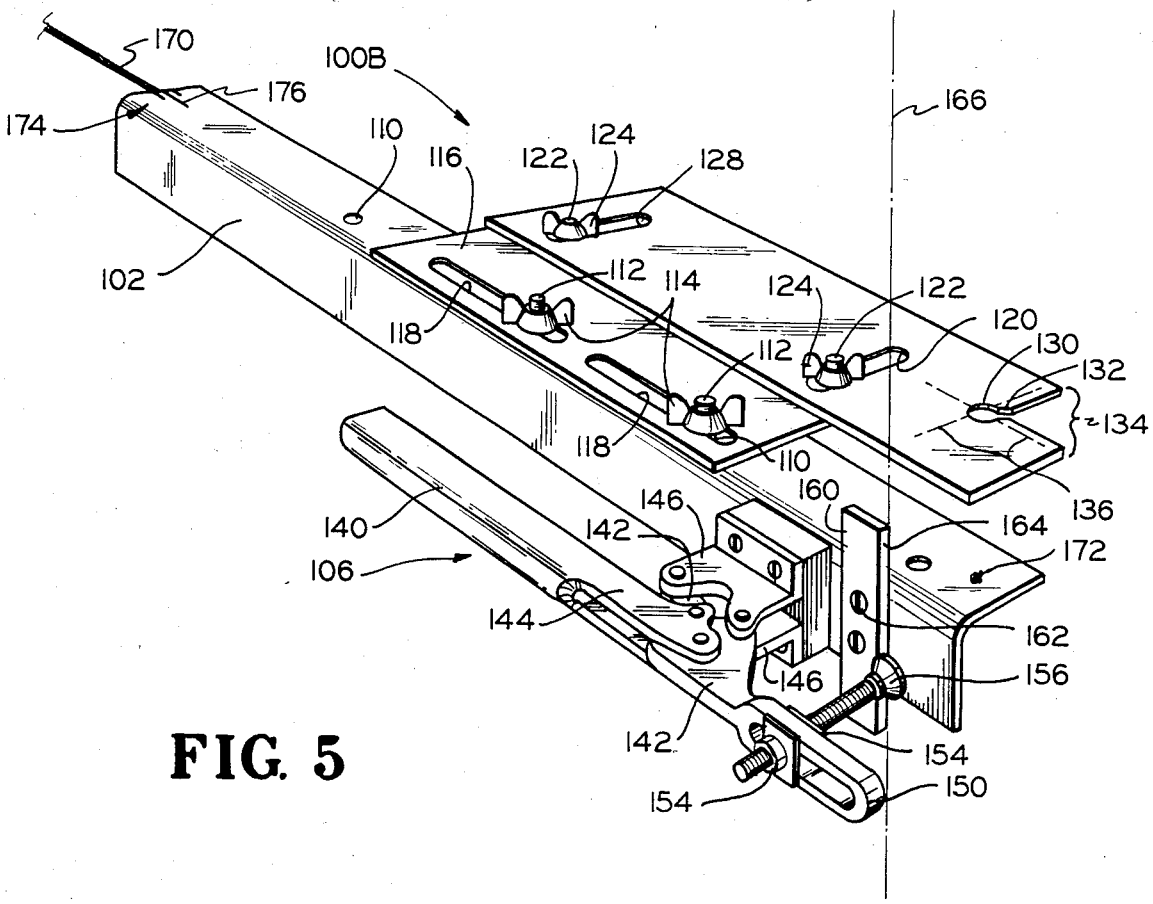
FIG. 5 is a perspective view of the right hand one of a mirror-image pair of guide reference assemblies according to the instant invention.
Figure 7:
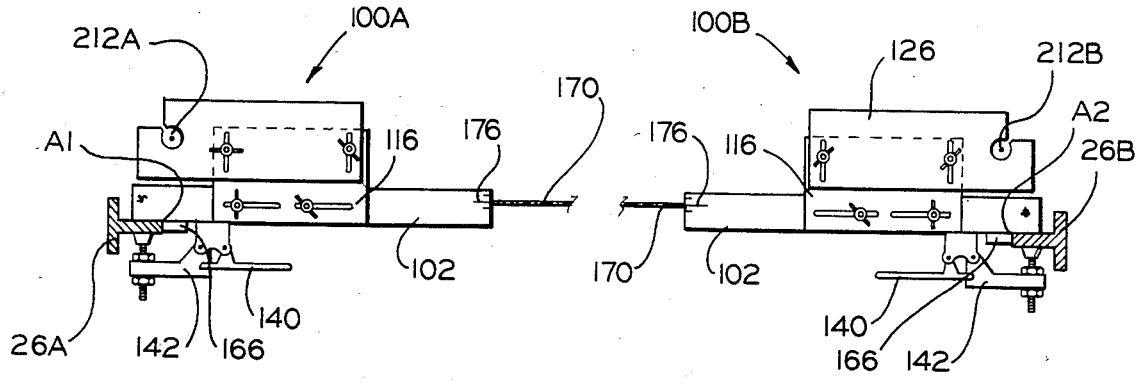
FIG. 7 is a plan view of the pair of mirror-image guide reference assemblies in place upon elevator guide rails during the positioning of such guide rails according to the instant invention.

Referring now to FIG. 5, a right hand reference guide assembly 100B for utilization in connection with the method of installing elevator guide rails according to the instant invention is illustrated. The assembly 100B is one of a mirror-image pair of such assemblies which includes a left hand reference guide assembly 100A as illustrated in FIG. 7. The assembly 100B includes a generally elongate, right angular frame 102 to which there are secured a plumb line reference assembly 104 and a clamping assembly 106. Components of the plumb line reference assembly 104 include a plurality of spaced-apart apertures 110 in one face of the frame 102. The plurality of apertures 110 provide a means of accommodation and adjustment as will be more fully explained subsequently. Through two of the apertures 110 are positioned bolts 112 and finger operable fasteners such as wing nuts 114. The bolts 112 and wing nuts 114 are utilized to secure a first adjustment plate 116 to the frame 102. The first adjustment plate 116 includes a pair of elongate slots 118 which receive the bolts 112. Preferably, the elongate slots 118 are approximately equal to the distance between adjacent apertures 110. As is apparent, the elongate apertures 114 are aligned with the long axis of the frame 102 and thus permit motion of the first adjustment plate 116 along this axis over a limit of travel defined by the length of the slots 118 and their interference with the bolts 112. The bolts 112 may be moved to the additional apertures 110 in order to shift the range of adjustability of the first adjustment plate 116 along the frame 102. A second pair of bolts 122 are secured to the first adjustment plate 116 and receive finger operable fasteners such as a second pair of wing nuts 124. The bolts 122 and wing nuts 124 are utilized to receive and selectively secure a second adjustment plate 126. The bolts 122 are received within a respective pair of elongate slots 128 in the second adjustment plate 126 oriented at right angles to the elongate slots 118 and the elongate axis of the frame 102. Cooperation between the bolts 122, wing nuts 124 and elongate slots 128 permit adjustment of the position of the second adjustment plate 126 along an axis normal to the axis of the frame 102 of the assembly 100 between the limits defined by interference between the bolts 122 and the elongate slots 128. Finally, the second adjustment plate 126 includes a through aperture 130 having a generally radially oriented slot 132 leading to a cutaway throat region 134. The aperture 130 receives a plumb line as will be more fully explained. A pair of intersecting cross hairs 136 scored, formed, painted or in some other fashion placed upon the second adjustment plate 126 defines a center, reference location within the aperture 130 to accurately locate the plumb line as will be more fully explained.

The clamping assembly 106 which is preferably disposed on an adjacent face of the frame 102 disposed at a right angle to that face to which the reference guide assembly 104 is secured is of the over center toggle type having a manually operable handle 140 which is pivotally secured to a clamp arm 142 and a toggle link 144 by conventional pivot pins. The opposite end of the toggle link 144 is secured to a stationary bracket 146 and is a portion of the clamp arm 142, both through the use of conventional pivot pins as illustrated. As the handle 140 is moved away from the frame 102, the clamp arm 142 likewise moves away from the frame 102 and vice versa. The assembly 106 is illustrated in FIG. 5 in its generally closed position. The clamp member 142 includes an elongate slot 150 which receives a threaded stud 152. Disposed upon the threaded stud 152 are a pair of nuts 154 which facilitate axial adjustment of the position of the threaded stud 152 relative to the clamp arm 142 in a conventional manner. The threaded stud 152 may also include a force dispersing shoe 156 secured thereto at its terminus adjacent the frame 102. Also associated with the clamping assembly 106 is a guide plate 160 which is secured by suitable means such as fasteners 162 to the side of the frame 102 adjacent the clamping assembly 106. The guide plate 160 provides a reference surface 164 against which the face 56 of a guide rail section 36 is disposed during the installation step as will be more fully described below. The throat or intersection of the reference surface 164 with the adjacent frame 102 defines an axis 166 which, as will be more fully explained below, is placed into coincidence with a corner of one of the guide rails 26A, 26B, 30A and 30B during the installation procedure.

Finally, the assembly 100B includes a guide line 170 which is secured to the side of the frame 102 to which the plumb line reference assembly 104 is secured but adjacent the end of such side proximate the clamping assembly 106 through a suitably sized aperture 172. The guide line 170 is a generally elastic line which extends between the mirror-image pair of assemblies 100A and 100B as illustrated in FIG. 7. The guide line 170 thus adjusts for a wide range of dimensional separation between the two assemblies 100A and 100B as will be readily appreciated. At the end of the frame 102 opposite the aperture 172 are a plurality of reference marks 174 and a center reference mark 176. The center reference mark 176 is positioned such that a reference line (and the guide line 170) extending between it and the aperture 172 is parallel to the elongate axis of the frame 102 and more specifically parallel to that portion of the frame 102 adjacent the guide plate 160 which engages the side surface 54 of a guide rail section 36. The purpose and features of the guide line 170 will be more fully described below.

Referring now to FIG. 6, an assembly 180 for stabilizing a plumb line during the installation of guide rails is illustrated. The stabilizing assembly 180 includes an elongate bar 182 which may be preferably formed of a right angular structural shape. The bar 182 includes an elongate slot or pair of slots 184 having a total length greater than the width of the flange 48 of a conventional guide rail section 36. Disposed within the slot are a pair of threaded fastener assemblies 186 consisting of a nut and bolt or similar selectively securable fastener device. Each of the threaded fastener assemblies 186 adjustably secures a respective one of a pair of guide rail clips 190 to the bar 182. Selective tightening of the threaded fastener assemblies 186 and appropriate positioning of the clips 190 thus permits securement of the bar 182 to the flange portion 48 of a guard rail section 36 as desired. Disposed on the surface of the bar 182 at right angles to that defining the elongate slot or slots 184 are a pair of captive threaded fasteners 192 having finger operable fasteners such as wing nuts 194 disposed thereon. The bolts 192 are disposed within a pair of suitably spaced-apart elongate slots 196 formed in a first adjustment plate 198. It will thus be appreciated that loosening of the wing nuts 194 permits sliding of the first adjustment plate 198 generally along an axis perpendicular to the plane of the rear face 48 of the guide rail section 36 to which the bar 182 is attached. At one end of the first adjustment plate 198 are disposed a second pair of captive threaded fasteners 200 having disposed thereon a respective pair of finger operable fasteners such as wing nuts 202. Again, the threaded fasteners 200 are disposed within a pair of elongate slots 204 which are formed in an adjustable arm 206. Loosening the wing nuts 202 thus permits motion along an axis defined by the elongate slots 204, a direction which is generally parallel to the rear face 48 of the guide rail section 36. At the end of the adjustable arm 206, generally proximate the guide rail section 36, is a thru slot 210 which receives a plumb line 212. The width of slot 210 is just slightly greater than the diameter of the plumb line 212. A set screw 214 extends across the slot 210 and into a threaded blind aperture (not illustrated). The set screw 214 may thus be tightened to cause a slight dimensional reduction in the width of the slot 210 thereby tightly gripping the plumb line 212 as will be readily understood. One stabilizing assembly 180 is secured to each of the guide rails 26A, 26B, 30A and 30B generally adjacent its lower terminus, adjusted to receive each plumb line 212 hanging in its true, vertical orientation such that the plumb lines 212 will be restrained from lateral motion during the installation process.

With reference now to FIGS. 1, 3, 4 and 7, the installation and securement of elevator car guide rails 26A and 26B and counterweight guide rails 30A and 30B according to the instant invention will now be described. As illustrated in FIG. 4, the first method step comprehends determining the transverse reference quarterline 220 and a quarterline normal thereto, the medial reference quarterline 222 of the elevator hoistway 20. The quarterlines 220 and 222 are determined by measurements of the hoistway 20 or dimensions thereof supplied by the builder. The reference quarterlines 220 and 222 are positioned at the midpoints of the sides 28 and rear wall 32, respectively, and thus also divide the area of the elevator hoistway 20 into four equal quarters. The lower extremities of the guide rails 26A and 26B are positioned to be coincident with the transverse quarterline 220 such that an associated elevator car will be properly positioned within the elevator hoistway 20 at its lowermost limit of traverse. Next, plumb lines 212A and 212B are dropped from the equipment room 24 at the top of the elevator hoistway 20. The plumb lines 212A and 212B extend the full vertical height of the hoistway 20 and, after having been allowed to stabilize in their true vertical positions and cease any swinging motion, may preferably be secured within the slot 210 of an associated plumb line stabilizing assembly 108, as illustrated in FIG. 6.

As illustrated in FIGS. 4 and 7, the next step is to secure the left hand reference guide assembly 108 to the left guide rail 26A and the right hand reference guide assembly 100B to the right guide rail 26B. This step is achieved by positioning the reference surface 164 of the clamping assembly 106 and adjacent portion of the frame 102 of each of the reference guide assemblies 100A and 100B against the end surface 56 and rail surface 54, respectively, of the respective guide rails 26A and 26B. More specifically, the axes A1 and A2 defined by corners of the guide rails 26A and 26B are placed into coincidence with the axes 166 of the respective assemblies 100A and 100B. The reference guide assemblies 100A and 100B may then be secured to the guide rails 26A and 26B respectively by pivoting the handles 140 toward the respective frames 102 of the assemblies 100A and 100B. The clamping assembly 106 may, of course, be adjusted through repositioning of the threaded stud 152 to accommodate different thicknesses of rail portions 50 of the rail sections 36. It should be appreciated that the initial vertical situs of attachment of the reference guides 100A and 100B will generally be at the lowermost regions of the guide rails 26A and 26B located and secured to the hoistway walls 28 with reference to the transverse reference quarterline 220, as described above. Next, the wing nuts 114 and 124 on the assemblies 100A and 100B are loosened such that the adjustment plates 116 and 126 may be repositioned in order that the plumb lines 212A or 212B can be received and centered within the respective aperture 130. The wing nuts 114 and 124 are then retightened. Also, at this time, the angular position of the reference guides 100A and 100B and respective guide rails 26A and 26B are adjusted such that the guide line 170 extending therebetween aligns with the reference marks 176 on each of the frames 102. Should this adjustment render either of the plumb lines 212A or 212B no longer centered within the apertures 130, the plates 116 and 126 may be readjusted as appropriate by loosening and retightening appropriate wing nuts 114 and 124 as will be readily appreciated. These steps are repeated until the plumb lines 212A and 212B are centered in the apertures 130 and the guide line 170 is aligned with the reference marks 176 as illustrated in FIG. 7. Through this procedure, the opposed surfaces 54 of the guide rails 26A and 26B are disposed in parallel planes P1 and P2 which are parallel to the quarterline 220 and the positions of the plumb line 212A and 212B relative to the corner axes A1 and A2 of the respective guide rails 26A and 26B (or vice versa) are recorded by the positions of the plates 116 and 126 of the respective reference guide assemblies 100A and 100B. The handles 140 are then released such that the reference guide assemblies 100A and 100B may be moved vertically up the guide rails 26A and 26B to a second location generally adjacent guide rail securement components illustrated in FIG. 3. Here, the reference guide assemblies 100A and 100B are resecured to the respective guide rails 26A and 26B as illustrated in FIG. 7 with the reference surfaces 164 in contact with the end guide surfaces 56 of the guide rails 26A and 26B and the axes 166 coincident with one of the rail corner axes A1 or A2. The positions of the guide rails 26A and 26B and their angular orientations are then adjusted until the plumb lines 212A and 212B are again centered within the apertures 130 and the guide line 170 is aligned with the reference marks 176 as illustrated in FIG. 7. In this manner, the associated guide rails 26A and 26B are positioned and aligned relative to one another and the plumb lines 212A and 212B as they were at the lower vertical location of attachment of the reference guide assemblies 100A and 100B previously described. The brackets 60 and plates 68 may then be adjusted appropriately and the associated bolts 64 and 70 tightened as will be readily appreciated. The foregoing step is then repeated at vertical intervals along the full vertical height of the guide rails 26A and 26B thereby aligning and orienting the full vertical length of the guide rails 26A and 26B with respect to one another and the associated plumb lines 212A and 212B as they were at the initial, lowermost location of attachment of the reference guide assemblies 100A and 100B.

This process is again repeated with regard to the counterweight guide rails 30A and 30B, their initial positions being determined by appropriate spacing from the backwall and appropriate face-to-face spacing to receive the associated counterweight. Access to the guide rails 26A and 26B and 30A and 30B along their length, may, of course, be achieved by a suitable temporary skip within the elevator hoistway 20, components of the permanent elevator car or other suitable means.

The foregoing disclosure is the best mode devised by the inventors for practicing this invention. It is apparent, however, that apparatus and methods incorporating modifications and variations will be obvious to one skilled in the art of vertical transportation. Inasmuch as the foregoing disclosure is intended to enable one skilled in the pertinent art to practice the instant invention, the following claims should not be construed to be limited thereby but should be construed to include such aforementioned obvious variations.

I claim:

1. A method of instaling guide rails in an elevator hoistway, comprising the steps of:

assembling at least a pair of rails each having a length substantially equal to the height of such hoistway;

suspending said pair of rails in such hoistways;

securing a lower end adjacent region of each of said pair of rails to the walls of said hoistway;

suspending a plumb line adjacent each of said pair of rails;

determining and recording the positions of each said lower end adjacent region of each of said pair of rails relative to said adjacent plumb line by positioning and securing a first member moveable along a first axis and a second member moveable along a second axis normal to said first axis;

utilizing said recorded relative positions to place vertically spaced apart upper regions of each of said pair of rails into said previously determined relative positions; and securing said upper regions of each of said pair of rails to the walls of said hoistway in said relative positions.

2. The method of claim 1 further including the step of restraining a lower end adjacent region of said plumb line against motion.

3. The method of claim 1 further including the step of positioning said pair of rails such that respective parallel faces of said pair of rails are disposed in parallel planes.

4. The method of claim 1 wherein the steps of utilizing said recorded relative positions and securing said upper regions are repreated at vertically spaced apart intervals along substantially the full length of said pair of guide rails.

5. An apparatus for installing elevator guide rails in a hoistway comprising, in combination:

a pair of guide assemblies;

each assembly including means for establishing a first axis parallel to the axis of a guide rail, means for selectively securing said axis establishing means to a guide rail;

reference means for receiving a plumb line, said plumb line defining a second axis parallel to said first axis; and means for selectively fixing the position of said reference means relative to said axis establishing means including a first member adjustably secured to said establishing means and moveable along a first axis and a second member moveable along a second axis normal to said first axis.

6. The apparatus of claim 5 further including means extending between said pair of guide assemblies for achieving a paralle, co-planar relationship between the opposed parallel faces of said pair of guide rails.

7. The apparatus of claim 5 wherein said assemblies each include a frame member.

8. The apparatus of claim 7 wherein each of said assemblies includes a throat defined by a portion of said frame member and a guide structure having a surface disposed normal to said portion of said frame member.

9. The apparatus of claim 5 wherein said second member is adjustably secured to said first member.

10. An apparatus for installing elevator guide rails in a hoistway comprising, in combination:

a pair of mirror-image guide assemblies;

each assembly including a frame member, means for engaging a first surface of a guide rail, means secured to said frame member for engaging a second surface of said guide rail, said second surface disposed normal to said first surface;

clamp means for selectively coupling said frame member to such guide rail;

a first member;

first selective securement means coupling said first member to said frame member for permitting adjustment of said first member relative to said frame member along a first axis;

a second member; and second selective securement means coupling said second member to said first member for permitting adjustment of said second member relative to said first member along a second axis normal to said first axis; and said second member including reference means for receiving a plumb line.

11. The apparatus of claim 10 further including an extensible cord secured to said frame member of each of said assemblies and extending between said pair of assemblies for obtaining a parallel, co-planar relationship of the respective opposed, parallel surfaces of a pair of guide rails.

12. The apparatus of claim 10 wherein said first securement means includes at least one elongate slot disposed in one of said frame members and said first member and a threaded fastener assembly extending from the other of said frame member and said first member through said elongate slot.

13. The apparatus of claim 10 wherein said second securement means includes at least one elongate slot disposed in one of said first members and said second member and a threaded fastener assembly extending from the other of said first member and said second member through said elongate slot.

14. The apparatus of claim 10 wherein said reference means includes an aperture having a radially oriented throat region and a pair of reference lines disposed at a right angle to one another and disposed radially of said aperture.

15. The apparatus of claim 10 further including means for securing a lower region of said plumb line to a guide rail.

* * * * *